US005638977A

United States Patent [19]

Bianchi

[11] Patent Number: 5,638,977

[45] Date of Patent: Jun. 17, 1997

[54] ASSEMBLY FOR SECURING A LID TO A CONTAINER

[76] Inventor: Angelo R. Bianchi, 340 West End Rd., South Orange, N.J. 07079

[21] Appl. No.: 501,811

[22] Filed: Jul. 13, 1995

[51] Int. Cl.[6] ..... B65D 45/28

[52] U.S. Cl. ..... 220/314; 215/273; 220/315; 220/323; 220/326; 220/908; 292/259 R

[58] Field of Search ..... 292/137, 259 R; 220/315, 323, 326, 243, 251, 250, 314, 327, 328, 908; 215/273, 277

[56] References Cited

U.S. PATENT DOCUMENTS

| | | | |
|---|---|---|---|
| 1,129,222 | 2/1915 | Nylund | 220/323 X |
| 1,267,284 | 5/1918 | Shanahan | 220/251 X |
| 1,399,680 | 12/1921 | Airgood | 220/327 |
| 1,580,016 | 4/1926 | Collins | 220/315 X |
| 1,728,945 | 9/1929 | Porter | 220/323 X |
| 1,773,507 | 8/1930 | Wingard et al. | 220/323 X |
| 1,974,539 | 9/1934 | Le Comte | 220/323 X |
| 2,238,379 | 4/1941 | Tiffany | 220/323 X |
| 2,632,580 | 3/1953 | Biddlecombe | 220/323 X |
| 2,661,974 | 12/1953 | Zehnder | 292/259 R X |
| 3,450,148 | 6/1969 | Mongelluzzo et al. | 220/327 X |
| 4,150,760 | 4/1979 | D'Orgelys | 220/251 X |
| 4,214,782 | 7/1980 | Boyer | 220/326 X |
| 4,320,851 | 3/1982 | Montoya | 220/908 X |
| 4,384,656 | 5/1983 | McQuiston et al. | 220/323 |
| 4,429,911 | 2/1984 | O'Neal et al. | 292/259 R |
| 4,520,921 | 6/1985 | Vissing | 220/326 X |
| 4,574,971 | 3/1986 | Leonard | 220/235 |
| 4,723,686 | 2/1988 | Pennisi | 220/908 X |
| 4,764,146 | 8/1988 | Auer et al. | 220/315 X |
| 4,822,197 | 4/1989 | DeMartino | 411/340 X |
| 4,822,226 | 4/1989 | Kennedy | 411/342 |

FOREIGN PATENT DOCUMENTS

| | | | |
|---|---|---|---|
| 4112357 | 10/1992 | Germany | 220/908 |
| 1704 | of 1872 | United Kingdom . | |
| 29 | of 1878 | United Kingdom . | |

*Primary Examiner*—Allan N. Shoap
*Assistant Examiner*—Robin A. Hylton

[57] ABSTRACT

A lid to be attached to a container, a garbage can for example, wherein the lid is secured by means of a system comprising holes placed in the lid rim in alignment with corresponding holes in the top of the container. A conduit is provided on the underside of the lid in alignment with the holes in the lid and the holes in the container. A securing rod passes through the conduit and the holes in the lid and container to secure the lid to the container. In use, the holes of the lid rim and the holes of the container are in registration with each other.

8 Claims, 2 Drawing Sheets

ASSEMBLY FOR SECURING A LID TO A CONTAINER

BACKGROUND OF INVENTION

The present invention relates to methods of providing secure lid covers for containers and especially to the containers/lid assemblies themselves. More specifically, the invention relates to a secure lid/container enclosure wherein lids may be secured to the containers to render them tamper-proof and animal proof. More specifically yet, the invention relates to trash containers as a specific embodiment, having lids thereon which are tamper-proof and secure against the invasion by animals.

THE PRIOR ART

The following patents illustrate trash receptacle lid fastening systems.

U.S. Pat. No. 4,384,656 has a mechanism associated with the top and center of the lid controlling bolts which may shift between a locked position which engages shoulders to an unlocked position in which the bolts are disengaged from the shoulders.

U.S. Pat. No. 4,320,851 shows two bolt assemblies on a trash can lid which are engagable with apertures in the trash can.

U.S. Pat. No. 2,661,974 shows a trash can lid equipped with springs which are engagable with projectiles on the can to secure the lid thereby.

U.S. Pat. No. 2,632,580 shows a trash can lid with a rotable handle thereon which controls each end of a two part rod between an open position and a closed position, the closed position involving engagement of curved ends of the rod with the lip of the container.

U.S. Pat. No. 2,238,379 also shows a rotable handle in a lid which controls rods hinged in the center thereof to provide a bent, obtusely angled rod in the unlocked position and an elongated straight rod in the closed position. The ends of the rod are hooked to engage the external bead of the container.

U.S. Pat. Nos. 1,773,507 and 1,728,945 also show a rotable lid handle with rods adapted to engage apertures on the container when rotated.

U.S. Pat. No. 1,618,145 shows a spring device for pressure fitting into a lid/container assembly whereby when extended the point end of the device engages an aperture of the container.

U.S. Pat. No. 1,129,222 has a plunger-like device in the center of a lid which when in the "up" position disengages from the side of the container but in the closed position engages the sides in locking position.

SUMMARY OF THE INVENTION

The present invention relates to a lid having a rim overhang to be attached to a container, a garbage can for example, wherein the lid is secured by means of a system comprising holes placed in the lid rim overhang in alignment with corresponding holes in the top of the container. In use, the holes of the lid rim overhang and the holes of the container are in registration with each other. The invention contemplates the use of two holes in each of the lid and container to receive a securing rod therethrough.

In use, it is preferred to supply a connecting or securing rod which can be releasably inserted through the holes and thereby engage the rim overhang of the lid and the container via securing means at each end of the rod. Thus, when the lid is placed on the container, one end of the rod, would be inserted through the holes from one end of the lid rim overhang diameter to the other end. The rod is provided with security means at each end to engage the sides of the lid rim and prevent slide through of the rod. The lid is thus secured in a unitary enclosure system.

DETAILED DESCRIPTION OF THE INVENTION

Figure 1:
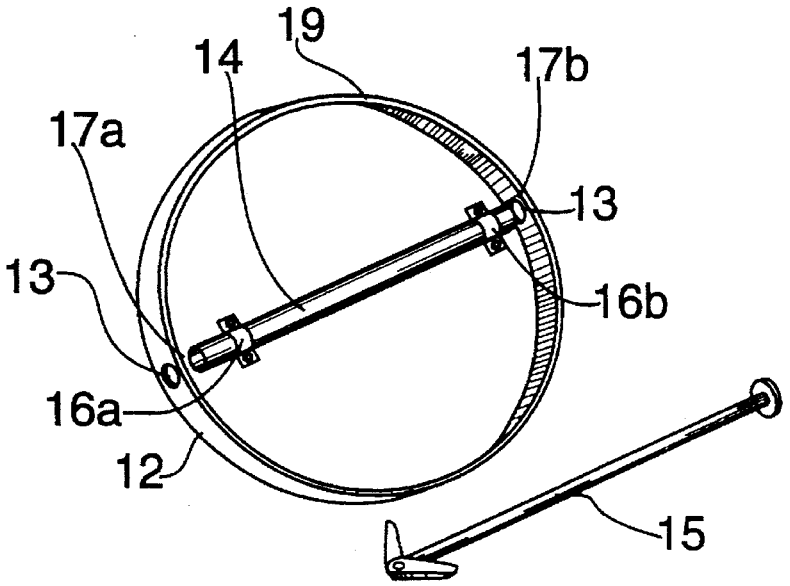
FIG. 1 shows a garbage can lid showing the placement of a securing rod conduit and one embodiment of a securing rod.
Figure 2:
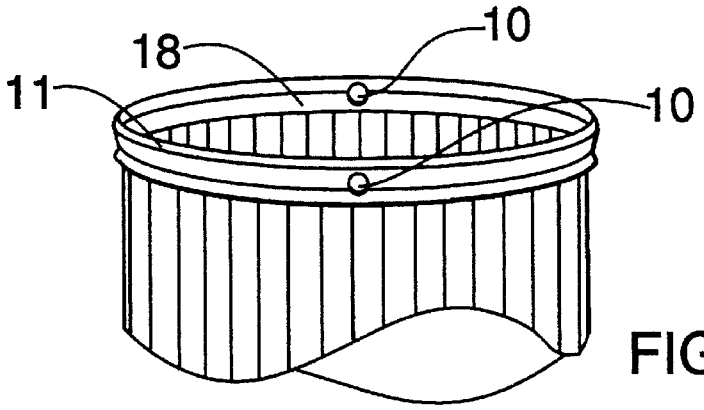
FIG. 2 the garbage can container without the lid.

As can be seen from FIGS. 1 and 2, securing rod receiving means 10 are placed at the top edge of the container 11, so as to provide an engaging and anchoring source for the lid (FIG. 1). The container is shown as being round, though any shaped containers may be used. The receiving means can be placed on a diameter of the container or as the connector of an arc. A diameter is preferred and is shown in FIG. 1. When the container and lid are not round, it is preferred to have the securing means placed on or near the geometric center of the system. A lid is provided as shown in FIG. 1 with corresponding rod receiving means 13 in the rim 12 overhang. Shown in FIG. 2 is a conduit 14 to be used for easing the insertion of the securing rod 15 (FIG. 3) through the holes 13 from one end of the lid to the other. The conduit means 14 is affixed to the lid preferably by means located on the top surface of the lid as by wiring the conduit means thereto, or welding if appropriate, or by other securing means such as brackets (see FIG. 1, 16*a* and 16*b*) and the like. There are spaces 17*a* and 17*b* located between the ends of the conduit means 14 and the rim of the lid so that when the lid is inverted and placed on the container there is sufficient room for the top edge of the container 18 to pass between the edges of the lid and the conduit means 14.

Figure 3:
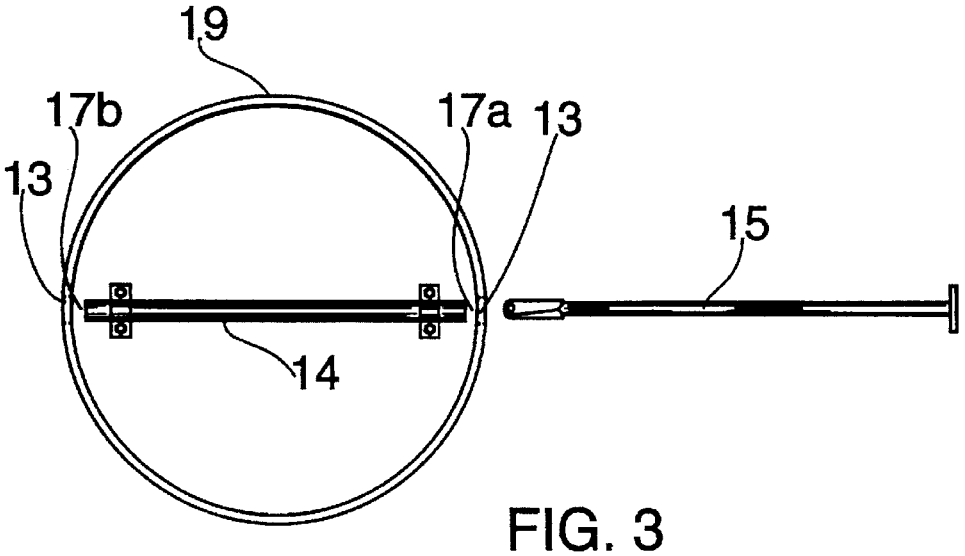
FIG. 3 shows one embodiment of a securing rod used in the present invention with a butterfly spring-loaded securing device in closed position prior to entry into the rod conduit means.
Figure 4:
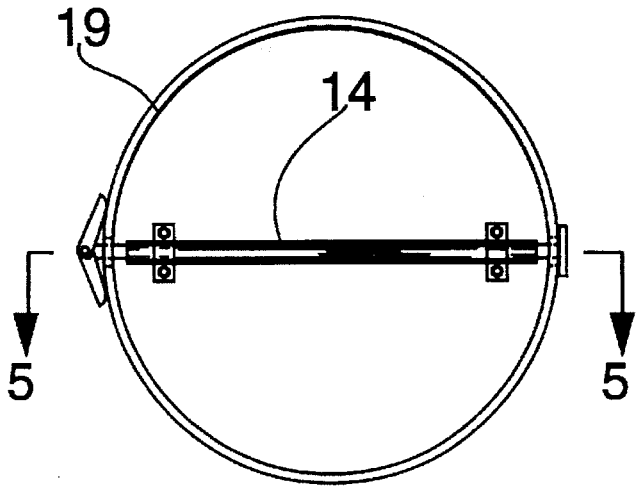
FIG. 4 shows the securing rod inserted through the rod conduit means.
Figure 5:
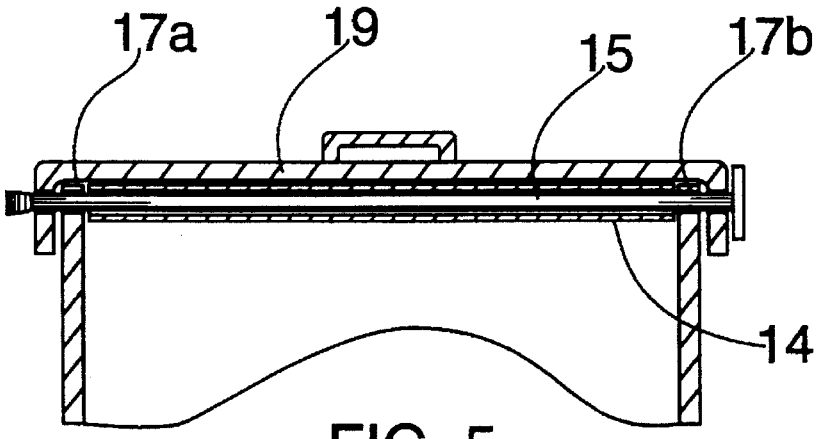
FIG. 5 shows the lid in place on the garbage receptacle in cross section along 5—5 of FIG. 4.
Figure 6:
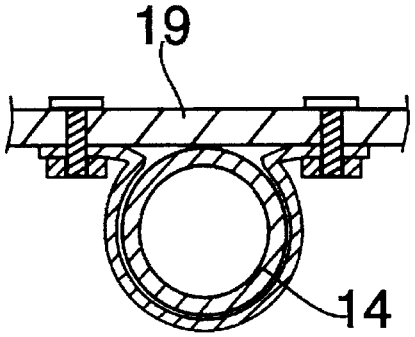
FIG. 6 shows a detail of one embodiment of securing the rod conduit to the receptacle lid.

In use, the lid is placed in proper register with the holes on the container, and is ready to receive the securing rod 15. In a preferred embodiment, the rod contains two butterfly securing means. The user removes at least one of the butterfly securing means from the rod, or if properly spring-loaded, leaves the butterfly means in place so that upon subsequent insertion the butterfly wings are compressed inside the conduit means 14 facilitating the insertion of the rod. The rod springs open once the inserted end is pushed completely through the conduit and emerges on the opposite side. On the securing rod at the end opposite the inserted end is located another securing means preferably in the form of a butterfly clamp, cotter pin or like means. Of course, it need not be configured in such a manner, but might also be equipped with a larger end simply to prevent the securing rod from passing through the hole as is shown in FIG. 3. In this regard, any securing means is appropriate. In fact, as one skilled in the art will appreciate, a butterfly spring-loaded securing means need not be used. In its place, other securing means such as nut and bolt configurations, or cone and press fit configurations may be employed.

Once the securing rod is in place, the lid is firmly secured on the container and can only be removed if the securing means or the end of the rod are removed and the securing rod removed. There is, thus, provided a stable lid/container arrangement secure against tampering, invasion by animals, inadvertent spillage from knocking over and the like.

There are other variations and equivalents that may be employed by one skilled in the art as will be immediately apparent. All of such equivalents and variations are intended to be included within the scope of the invention.

What is claimed is:

1. A lid/container system comprising:

(a) a container comprising a top portion and a lid therefor, said lid comprising a central panel having a top surface and an undersurface, and an outer periphery, said lid further having a rim extending downwardly from said outer periphery of said central panel, said lid engageable with said top portion, each of said lid and said top portion comprising securing rod receiving means thereon which are capable of being in registration with each other when said lid is placed on the container, (b) said lid comprising conduit means for housing a securing rod and affixed to said central panel of said lid under the top surface thereof and in alignment with said securing rod receiving means on said lid and on said top portion and wherein said conduit means is spaced from the rim of said lid to permit unhampered engagement of the lid with said container, and (c) a securing rod insertable into said securing rod receiving means and through said conduit means, said securing rod being provided with securing means whereby when said securing rod is in place, said securing means prevents the inadvertent removal of the securing rod from the securing rod receiving means.

2. The lid/container system of claim 1 wherein a butterfly spring-loaded securing device is provided on at least one end of said securing rod.

3. The lid/container system of claim 1 wherein the securing rod receiving means is placed essentially on the geometric center of the lid/container system.

4. The lid/container system of claim 3 wherein said system is round and the geometric center is essentially the diagonal.

5. The lid/container system of claim 1 wherein said rim of said lid overhangs and is engageable with said top of said container.

6. The lid/container system of claim 5 wherein a butterfly spring-loaded securing device is provided on at least one end of said securing rod.

7. The lid/container system of claim 5 wherein the securing rod receiving means is placed essentially on the geometric center of the lid/container system.

8. The lid/container system of claim 7 wherein said system is round and the geometric center is essentially the diagonal.

* * * * *